US006811438B1

(12) United States Patent
Ko

(10) Patent No.: US 6,811,438 B1
(45) Date of Patent: Nov. 2, 2004

(54) HIGH-SPEED LOW PROFILE CABLE ASSEMBLY

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/650,384

(22) Filed: Aug. 27, 2003

Related U.S. Application Data

(63) Continuation-in-part of application No. 10/431,148, filed on May 6, 2003, now Pat. No. 6,699,075.

(51) Int. Cl.[7] ..... H01R 13/648
(52) U.S. Cl. ..... 439/607; 439/610
(58) Field of Search ..... 439/607, 98, 930, 439/608–610, 92, 95, 181, 939

(56) References Cited

U.S. PATENT DOCUMENTS 6,162,086 A 12/2000 Kuo
6,179,662 B1 1/2001 Kuo
6,234,840 B1 * 5/2001 Nakata et al. ..... 439/607
6,394,844 B1 * 5/2002 Frias Valero et al. ..... 439/608
6,506,075 B2 * 1/2003 Chiran et al. ..... 439/607
6,641,429 B1 * 11/2003 Wu ..... 439/465
6,663,420 B1 * 12/2003 Xiao ..... 439/502
6,699,075 B1 * 3/2004 Ko ..... 439/610
6,705,899 B1 * 3/2004 Ji ..... 439/660
6,722,924 B1 * 4/2004 Zhou et al. ..... 439/608
6,743,051 B2 * 6/2004 Hayashi ..... 439/620

* cited by examiner

*Primary Examiner*—Ross Gushi
*Assistant Examiner*—Phuongchi Nguyen
(74) *Attorney, Agent, or Firm*—Wei Te Chung

(57) ABSTRACT

A cable assembly (1) comprises an insulative housing (10) receiving a plurality of electrical terminals (12) therein and a metallic shielding (30) attached to the housing. The shielding forms an inner space for accommodating the housing and an adapter (4). The adapter has a connecting portion (41) extending out of an opening (3242) formed at a longitudinal side wall (324) of the shielding. A channel (42) is formed in the adapter such that a cable (5) can extend through the channel and into the space in the shielding to establish electrical connection with the terminals in the housing.

6 Claims, 5 Drawing Sheets

HIGH-SPEED LOW PROFILE CABLE ASSEMBLY

CROSS REFERENCE TO RELATED APPLICATION

This application is a continuation-in-part of U.S. Pat. application Ser. No. 10/431,148, filed on May 6, 2003, now U.S. Pat. No. 6,699,075, entitled "HIGH-SPEED LOW PROFILE CABLE ASSEMBLY WITH IMPROVED EMI SHIELDING," and invented by the same inventor as that of the present application.

BACKGROUND OF THE INVENTION

1. Field of the Invention

The present invention relates to the art of electrical connectors, and more particularly to a cable assembly having conductive wires extending through a longitudinal side wall of a shielding of an electrical connector thereby providing a low profile, the cable assembly providing EMI (Electro Magnetic Interference) protection to ensure reliable high-speed signal transmission.

2. Related Art

A cable assembly is commonly used to electrical interconnect two separate electrical systems. The cable assembly typically includes a cable and two cable end connectors respectively connected to ends of the cable. The cable can be a coaxial cable, a flat cable or a multi-wire cable, any of which electrically connects to electrical terminals of the cable end connectors by any of several commonly used connecting technologies. Such technologies include soldering, crimping, and IDC (Insulation Displacement Contact) technology.

With the popularization of portable electronic devices such as notebook computers, a cable assembly used to transmit signals in such devices is required to have a minimized cable diameter as well as a low profile configuration for at least one of the cable end connectors. That way, the cable assembly does not occupy too much space within the portable device. Further, with the development of high-speed signal transmission technology, the cable assembly needs to reliably transmit high-speed signals. A metallic shielding is commonly required to be attached to the cable assembly, in order to prevent EMI (Electro Magnetic Interference) in relation to the external environment. The metallic shielding is often called an EMI shielding.

Attaching an EMI shielding onto an insulative housing of a cable end connector has been widely practiced in the art, and pertinent examples of such structures are disclosed in U.S. Pat. Nos. 6,162,086 and 6,179,662. However, these structures have shortcomings; that is, either not satisfactorily meeting the requirement of ensuring high-speed signal transmission, or not satisfactorily meeting the requirement of having a low profile configuration for the cable end connector.

U.S. Pat. No. 6,162,086 discloses a cable assembly having an outer EMI shielding. The cable is received into the housing of the connector from a top wall of the connector. When the connector is mounted to a substrate, an overall height of the connector and substrate is increased. The high configuration of the connector occupies a good deal of valuable space. Therefore, it is difficult to use the connector in a compact electronic device.

U.S. Pat. No. 6,179,662 discloses another kind of cable assembly. The cable is received into the housing of the connector from a first transverse end wall of a connector body. Therefore, the overall height of the cable assembly is less than that disclosed in U.S. Pat. No. 6,162,086. However, the cable assembly has disadvantages that reduce high-speed signal transmission performance. Each terminal in the connector body is connected with a corresponding signal wire of the cable. Some of the signal wires extend all the way through to an opposite second transverse end wall of the connector body, while other signal wires only extend a little beyond the first transverse end wall of the connector body. That is some of the signal wires are substantially longer than other signal wires. The difference between the lengths of these two types of signal wires is substantially along a length of the connector body. When the cable transmits high-speed signals, the difference in lengths of the signal wires impairs the synchronicity and accuracy of signal transmission.

Therefore, what is needed is a new low profile cable assembly that overcomes the above-described shortcomings.

SUMMARY OF THE INVENTION

An object of the present invention is to provide a cable assembly having an EMI shielding which maintains a low-profile configuration for the cable assembly as well as yielding excellent EMI performance.

Another object of the present invention is to provide a metallic shielding for a low profile cable end connector, the shielding being easily attached to the connector and yielding reliable EMI protection throughout the connector and an associated cable.

To fulfill the above objects, a cable assembly in accordance with the present invention comprises an insulative housing having a plurality of electrical terminals received therein. The housing has a mating surface adapted to mating with a mating header connector. A metallic shielding, which comprises a first portion and a mating second portion, is attached to the housing, the shielding functions as an EMI device. The shielding substantially surrounds the housing, and has a first opening in alignment with the mating surface of the housing and a second opening formed near a middle portion of one longitudinal side wall of the shielding. Conductive wires of a cable extend through the second opening and establish electrical connection with the terminals in the housing.

An adapter, which is made of conductive material and is partially received in the shielding, comprises a base retained between the first and second portions of the shielding and a cylindrical connecting portion extending out of the shielding from the second opening in the side wall of the shielding. An inner channel is defined throughout the adapter such that the conductive wires of the cable can extend through the adapter and enter the shielding, and inner wall of the channel contacts with an EMI shielding in the cable. The shielding, the adapter and the EMI shielding of the cable cooperatively provide overall EMI protection throughout the cable assembly, and the adapter can also reinforce the strength of the cable assembly.

Other objects, advantages and novel features of the present invention will become more apparent from the following detailed description when taken in conjunction with the accompanying drawings.

DETAILED DESCRIPTION OF THE PREFERRED EMBODIMENTS

Figure 1:
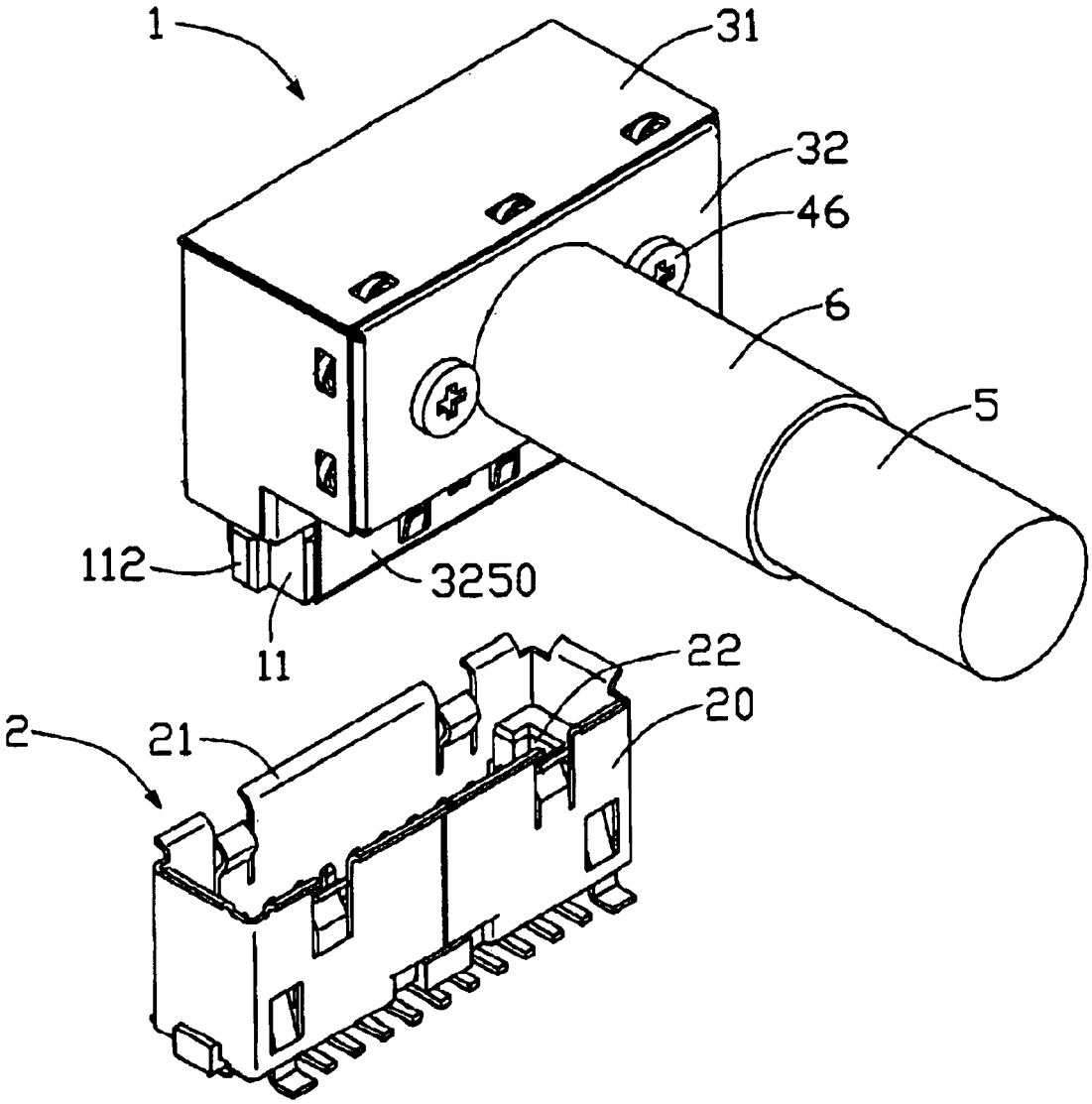
FIG. 1 is an isometric view of a cable assembly in accordance with a preferred embodiment of the present invention, together with a mating header connector.

FIG. 1 shows a cable assembly 1 in accordance with the preferred embodiment of the present invention, together with a header connector 2 adapted to mate with the cable assembly 1. Typically, the header connector 2 is mounted onto a substrate such as a motherboard (not shown), and the cable assembly 1 is connected with a separate electronic component such as a hard disk drive (HDD, not shown), thereby forming an electrical system for establishing electrical connection between the substrate and the electronic component.

Figure 2:
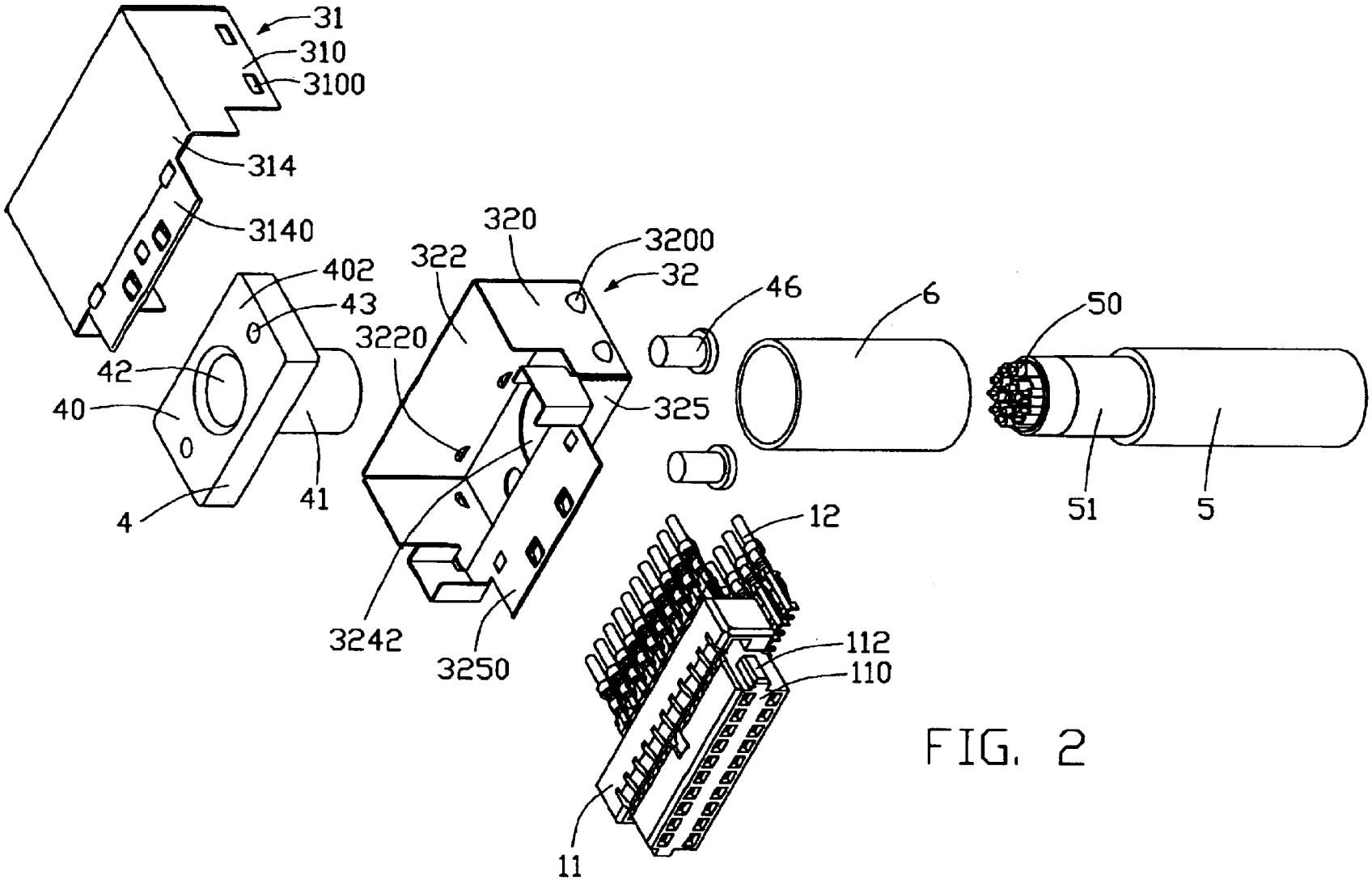
FIG. 2 is an exploded view of the cable assembly of FIG. 1, but viewed from another aspect.

Referring also to FIG. 2, the cable assembly 1 comprises an insulative housing 11, a plurality of electrical terminals 12 adapted to be received in passageways of the housing 11, a metallic shielding 30 (see also FIG. 3) adapted to be attached to the housing 10, an adapter 4 adapted to be retained in the shielding 30, a cable 5 adapted to extend into the shielding 30 through the adapter 4, and a sleeve 6 adapted to secure the adapter 4 and the cable 5 together. The housing 11 has a mating surface 110 facing toward the connector 2. A pair of projections 112 is formed on opposite ends of the housing 11 respectively, for coupling in a corresponding pair of recesses 22 defined in opposite end walls of the connector 2 respectively. The projections 112 and recesses 22 thereby provide polarized mating of the cable assembly 1 and the connector 2. Each terminal 12 is connected with a corresponding conductive wire 50 of the cable 5 through a crimping portion formed at a rear end of the terminal 12. The crimping portion crimps a conductive core of the wire 50. An EMI (Electro Magnetic Interference) shielding 51 surrounds all the wires 50 of the cable 5 while is surrounded by an insulative jacket (not labeled).

Figure 3:
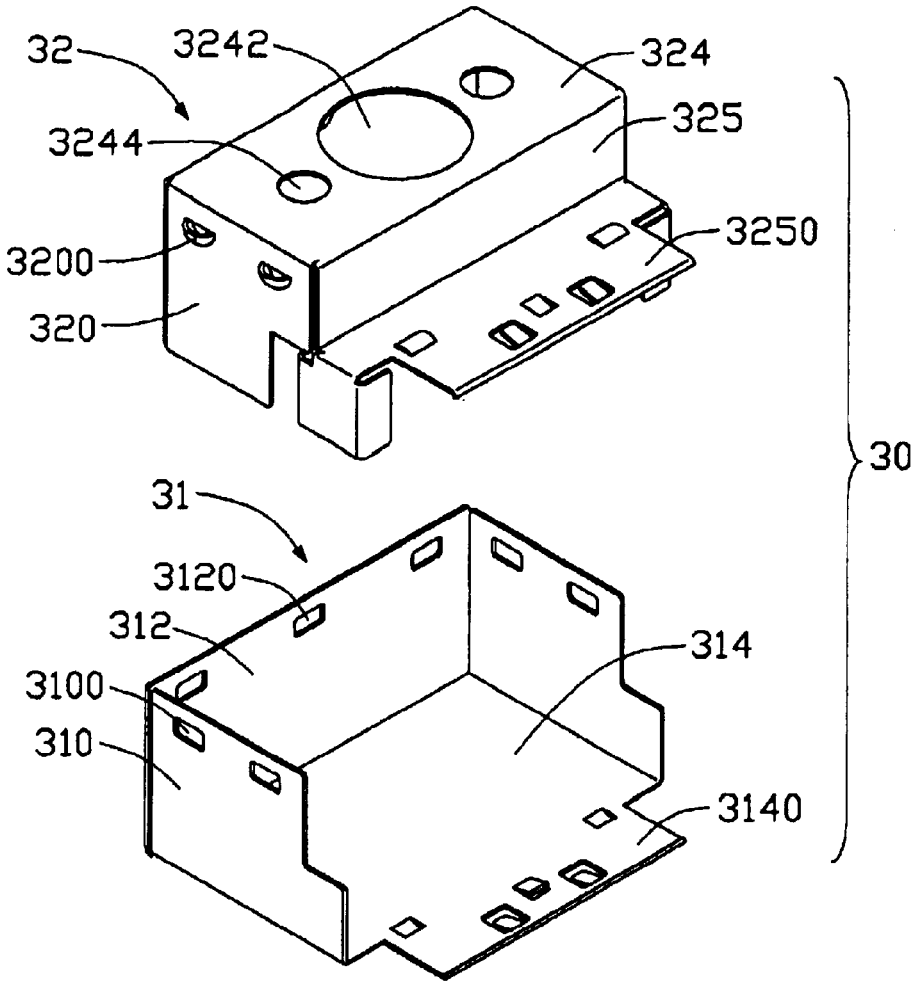
FIG. 3 is an exploded view of a metallic shielding of the cable assembly of FIG. 1, but viewed from another aspect, the shielding comprising a first portion and a second portion.

Referring also to FIG. 3, the shielding 30 is formed by stamping and bending metallic sheet material. The shielding 30 includes a first portion 31, and a second portion 32 coupled with the first portion 31.

The first portion 31 comprises two opposite end walls 310, a top wall 312, and a side wall 314 interconnecting the end walls 310 and the top wall 312. The end walls 310 and the top wall 312 respectively define a plurality of recesses 3100, 3120 therein. The side wall 314 has a first tongue portion 3140 extending downwardly therefrom. When the shielding 30 is attached to the housing 11, the first tongue portion 3140 is positioned to be substantially flush with the mating surface 110 of the housing 11 (best seen in FIG. 1).

The second portion 32 comprises two opposite end walls 320, a top wall 322, a bottom wall 325, and a side wall 324 interconnecting the end walls 320 and the top wall 322. The end walls 320 and the top wall 322 respectively have a plurality of bulges 3200, 3220 formed thereon. The bottom wall 325 has a second tongue portion 3250 extending downwardly therefrom. When the shielding 30 is attached to the housing 11, the second tongue portion 3250 is positioned to be substantially flush with the mating surface 110 of the housing 11 (see FIG. 1). A second opening 3242 is defined in a middle portion of the side wall 324. A pair of holes 3244 is defined in the side wall 324 at opposite sides of the second opening 3242 respectively.

When the first and second portions 31, 32 are coupled together, the end walls 310 of the first portion 31 are coupled with the end walls 320 of the second portion 32 by snapping the bulges 3200 into the recesses 3100. In addition, the top wall 312 of the first portion 31 is coupled with the top wall 322 of the second portion 32 by snapping the bulges 3220 into the recesses 3120. The combined first and second portions 31, 32 cooperatively define a receiving space therein, for receiving the housing 11. The receiving space comprises a first opening (not labeled), corresponding to the mating surface 110 of the housing 11. The opening 3242 formed in the side wall 324 of the second portion 32 is called a second opening.

Figure 4:
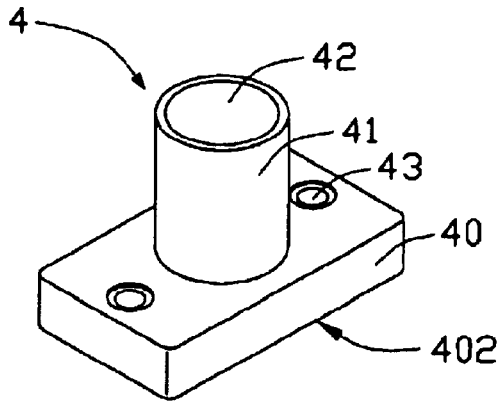
FIG. 4 is an isometric view of an adapter of the cable assembly of FIG. 2, but viewed from another aspect.

Referring also to FIG. 4, the adapter 4 is made of rigid material such as steel. The adapter 4 comprises a flat base 40, and a cylindrical connecting portion 41 extending perpendicularly forwardly from the base 40. An inner channel 42 is defined through the adapter 4, the channel 42 spanning from a front end of the connecting portion 41 to a bottom surface 402 of the base 40. A diameter of the channel 42 is slightly less than a diameter of the second opening 3242 of the shielding 30, and is slightly greater than a diameter of the EMI shielding 51 of the cable 5. A pair of through locating holes 43 is defined in the base 40 at opposite sides of the connecting portion 41 respectively. When the adapter 4 is attached in the shielding 30, the locating holes 43 are aligned with the holes 3244 of the second portion 32 of the shielding 30.

Referring particularly to FIG. 2, a pair of fasteners 46 is adapted to be inserted through the locating holes 43 of the adapter 4 and the holes 3244 of the shielding 30 in order to secure the adapter 4 in the shielding 30. The sleeve 6 is used to protect a joint of the cable 5 and the adapter 4. An inner diameter of the sleeve 6 is slightly greater than an outer diameter of the connecting portion 41, and slightly greater than a diameter of the cable 5 such that the cable 5 can extend through the sleeve 6.

Figure 5:
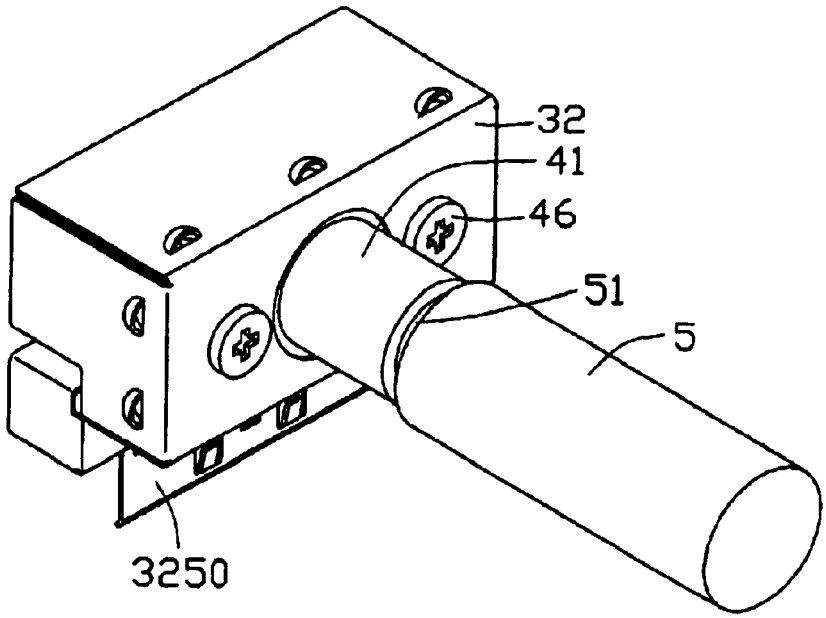
FIG. 5 is an isometric view of the cable assembly of FIG. 1, but not showing a housing or the first portion of the shielding.
Figure 6:
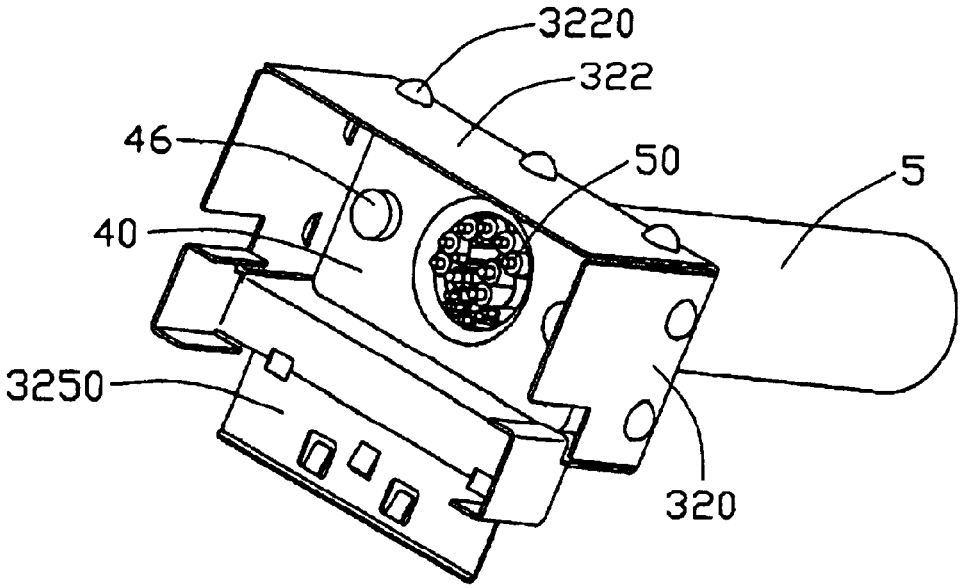
FIG. 6 is similar to FIG. 5, but viewed from another aspect.
Figure 7:
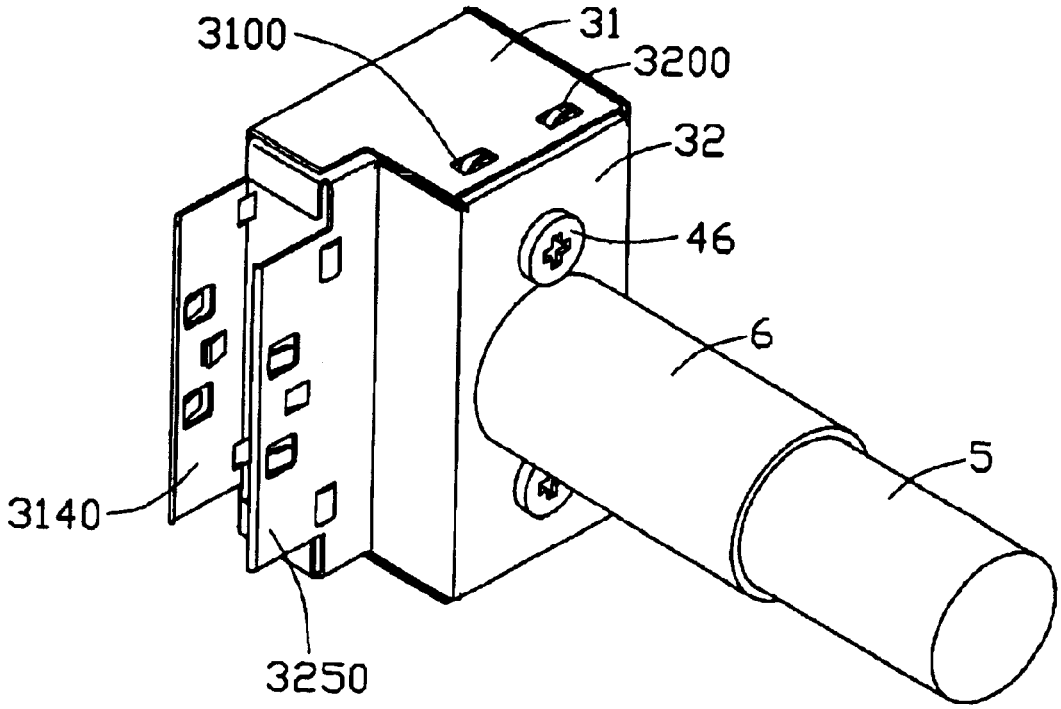
FIG. 7 is similar to FIG. 5, but showing the first portion of the shielding, and viewed from another aspect.

Referring to FIGS. 5, 6 and 7, assembly of the cable assembly 1 comprises the following steps. Firstly, the adapter 4 is inserted into the second portion 32 of the shielding 30. The connecting portion 41 of the adapter 4 is extended through the second opening 3242 of the second portion 32. The base 40 of the adapter 4 abuts the side wall 324, and is fittingly received between the bottom wall 325 and the top wall 312. The connecting portion 41 extends out of the second portion 32 through the second opening 3242. Secondly, the sleeve 6 is slidably engaged around the cable 5. The cable 5 is extended through the channel 42 of the adapter 4. Ends of the wires 50 of the cable 5 are positioned in the second portion 32, and the EMI shielding 51 of the cable 5 in the channel 42 abuts and electrically contacts an inner wall of the connecting portion 41. Thirdly, the fasteners 46 are extended through the holes 3244 of the side wall 324 and the locating holes 43 of the base 40, in order to attach the second portion 32 to the adapter 4. Free ends of the fasteners 46 protrude beyond the bottom surface 402 of the base 40. The sleeve 6 is slid along the cable 5 and over the connecting portion 41 until one end of the sleeve 6 abuts the side wall 324. Fourthly, the housing 10 is inserted into the second portion 32, and each terminal 12 of the housing 10 is connected with a corresponding wire 50 of the cable 5. Finally, the first portion 31 is coupled with the second portion 32 to form the shielding 30. The end walls 310 of the first portion 31 are coupled with the end walls 320 of the second portion 32 by snapping the bulges 3200 into the recesses 3100. The top wall 312 of the first portion 31 is coupled with the top wall 322 of the second portion 32 by snapping the bulges 3220 into the recesses 3120.

From the above description, it will be apparent that the cable assembly 1 of the present invention provides several features that overcome shortcomings extant in the art. The second opening 3242 of the shielding 30 is located and dimensioned so that the cable 5 extends into the connector 2 via a middle portion of the side wall 324 of the shielding 30 in a direction perpendicular to a direction of mating of the connector 2 onto the substrate. This minimizes an overall height of the cable assembly 1. Additionally, the cable 5 extends into the connector 2 via the second opening 3242 located in the middle portion of the side wall 324 of the shielding 30, such that the wires 50 of the cable 5 in the housing 11 are arranged substantially symmetrical with respect to the second opening 3242. Therefore the wires 50 can be terminated to terminals 12 in the housing 11 in a substantially symmetrical manner. This allows synchronicity and accuracy of high-speed signal transmission. Furthermore, the shielding 30 has the adapter 4 that not only secures the cable 5 to the shielding 30, but also electrically interconnects the EMI shielding 51 of the cable 5 with the shielding 30, thereby establishing complete EMI protection throughout the connector 2 and the cable 5. Moreover, referring to FIG. 1, the connector 2 also has a metallic shielding 20. Peripheral edge portions of the shielding 20 are flared to form guiding flanges 21, which facilitate insertion of the cable assembly 1 into the connector 2. When the cable assembly 1 is inserted into the connector 2, the projections 112 of the housing 11 are received in the recesses 22 of the connector 2, and the first and the second tongue portions 3140, 3250 of the shielding 30 engage with the shielding 20. Thus, complete EMI protection throughout the cable assembly 1 and the connector 2 is established.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulative housing having a plurality of electrical terminals received therein;

a metallic shielding having a space for receiving the housing, an opening being defined in a longitudinal side wall of the shielding parallel to the housing;

an adapter having a base received in the space and a connecting portion extending from the base and out through the opening of the shielding, a channel being defined through the adapter from the connecting portion toward the base;

a cable extending through the channel into the space of the shielding and establishing electrical connection with the terminals of the housing;

wherein the shielding comprises a first portion and a second portion coupled with the first portion to form the space;

wherein the opening is formed at a middle portion of a side wall of the second portion;

wherein the side wall of the shielding defines a hole adjacent the opening, the base of the adapter defines a locating hole in alignment with the hole of the side wall, and a fastener extends through the hole of the side wall and the locating hole of the base for attaching the adapter to the shielding;

wherein a sleeve attached to the adapter and the cable, the sleeve abutting the side wall of the shielding and enclosing the connecting portion of the adapter and at least part of the cable.

2. The cable assembly as claimed in claim 1, wherein the cable comprises a plurality of conductive wires enclosed by an electro magnetic interference (EMI) shielding.

3. The cable assembly as claimed in claim 2, wherein a diameter of the channel of the adapter is slightly greater than a diameter of the EMI shielding of the cable, and an inner wall of the adapter at the channel electrically contacts the EMI shielding.

4. A cable assembly comprising:

an insulative housing having a plurality of electrical terminals received therein;

an outer shielding substantially covering the housing;

an adapter, part thereof residing in the shielding and another part thereof being outside the shielding, a channel being defined through the adapter and into the shielding;

a cable extending through the channel of the adapter into the shielding and electrically connecting with the terminals of the housing;

wherein the shielding comprises a first portion and a second portion coupled with the first portion, thereby define a space accommodating the housing and said part of the adapter;

wherein the shielding defined a first opening in a mating face of the cable assembly for leading the housing into the space, and further defines a second opening at the middle portion of the side wall of the shielding that is perpendicular to the mating face and parallel to the housing;

wherein the said part of the adapter residing in the shielding comprises a base, and said part of the adapter outside the shielding is a connecting portion extending from the base out through the second opening, the channel being defined through the base and the connecting portion;

wherein a fastener extending through the hole defined in the shielding and a locating hole defined in the base of the adapter and thereby securing the adapter to the shielding;

wherein a sleeve enclosing the connecting portion of the adapter and at least part of the cable, one end of the sleeve abutting the side wall of the shielding.

5. The cable assembly as claimed in claim 4, wherein an inner wall of the channel in the adapter contacts an electro magnetic interference (EMI) shielding of the cable in the channel.

6. An electrical system, comprising:

a cable assembly including an insulative housing having a plurality of electrical terminals received therein and a metallic shielding attached to the housing, an adapter having one part residing in the shielding and another part outside the shielding, the adapter defining a channel therethrough and into the shielding, a cable extending through the channel of the adapter into the shielding and electrically connecting with the terminals in the housing; and a header connector having a metallic shielding, attached thereon, said shielding electrically connecting with the shielding of the cable assembly when the header connector is mated with the cable assembly;

wherein a pair of projections is formed on the housing, the projection being received in a pair of recesses defined in the header connector for polarized mating of the cable assembly and the header connector.

* * * * *